US012123689B1

(12) United States Patent
Beal

(10) Patent No.: US 12,123,689 B1
(45) Date of Patent: Oct. 22, 2024

(54) LONG RANGE JACKETED PROJECTILE

(71) Applicant: True Velocity IP Holdings, LLC, Garland, TX (US)

(72) Inventor: Harold F. Beal, University Park, TX (US)

(73) Assignee: True Velocity IP Holdings, Inc., Garland, TX (US)

( * ) Notice: Subject to any disclaimer, the term of this patent is extended or adjusted under 35 U.S.C. 154(b) by 0 days.

(21) Appl. No.: 18/199,341

(22) Filed: May 18, 2023

(51) Int. Cl.
*F42B 12/78* (2006.01)

(52) U.S. Cl.
CPC ..... *F42B 12/78* (2013.01)

(58) Field of Classification Search
CPC ..... F42B 12/74; F42B 12/78
USPC ..... 102/514–516, 501, 439
See application file for complete search history.

(56) References Cited

U.S. PATENT DOCUMENTS

| | | | | |
|---|---|---|---|---|
| 627,929 | A | 6/1899 | Andrews et al. | |
| 3,485,173 | A | 12/1969 | Morgan | |
| 3,866,536 | A | 2/1975 | Greenberg | |
| 4,128,060 | A | 12/1978 | Gawlick et al. | |
| 6,048,379 | A | 4/2000 | Bray et al. | |
| 6,070,532 | A | 6/2000 | Halverson | |
| 6,257,149 | B1 | 7/2001 | Cesaroni | |
| 7,000,547 | B2 | 2/2006 | Amick | |
| 7,069,834 | B2 | 7/2006 | Beal | |
| 7,243,588 | B2 | 7/2007 | Beal | |
| 8,881,654 | B2 | 11/2014 | Seecamp | |
| 9,335,137 | B2 | 5/2016 | Maljkovic et al. | |
| 11,965,723 | B2 * | 4/2024 | Beal | C22C 1/045 |
| 2008/0196616 | A1 | 8/2008 | Cziglenyi | |
| 2013/0092041 | A1 | 4/2013 | Seecamp | |
| 2016/0377397 | A1 * | 12/2016 | Winge | F42B 33/00 86/19.5 |
| 2018/0313639 | A1 | 11/2018 | Peterson | |
| 2019/0277610 | A1 | 9/2019 | Eberhart | |

FOREIGN PATENT DOCUMENTS

| | | | |
|---|---|---|---|
| DE | 3840165 | A1 | 7/1990 |
| DE | 10045009 | A1 | 5/2001 |
| WO | 2018218292 | A1 | 12/2018 |

* cited by examiner

*Primary Examiner* — Reginald S Tillman, Jr.
(74) *Attorney, Agent, or Firm* — Burdick Patents, P.A.; Sean D. Burdick; Colin L. Honan

(57) ABSTRACT

A long range jacketed projectile has a cavity defined in the base end of the projectile core that is substantially filled with polymer material during the jacketing process. The cavity is configured to lighten the core, which lightens the overall weight of the projectile, and move the center of gravity closer to the center of pressure when compared to a conventional long range projectile. The polymer jacket lightens the projectile weight, which when combined with the lighter core, allows the projectile to attain a flatter trajectory at increased maximum velocities.

20 Claims, 3 Drawing Sheets

Section A-A

Section A-A

LONG RANGE JACKETED PROJECTILE

RELATED APPLICATIONS

None.

BACKGROUND OF THE INVENTION

Field of the Invention

The inventive concepts disclosed herein relate generally to firearm ammunition and methods of manufacture thereof, and, more particularly, to polymer jacketed projectiles with improved flight stability.

Description of Related Art

Ammunition cartridges of the type commonly used in modern firearms are generally well known in the art. These ammunition cartridges typically include a cylindrical case that carries an internal payload, e.g., propellant powder, and has an open end for receiving a projectile. The size and shape of the cartridge and projectile will typically be dependent on the firearm used. The end opposite the projectile receiving end is typically closed about a means for igniting the internal payload, e.g., a primer is usually disposed in the base end of a cartridge. When chambered in a firearm, the projectile faces the bore of the firearm and the base end faces a firing mechanism, e.g., firing pin. When the primer is struck by the firing pin, a flash is produced which ignites the propellant powder within the case to propel the projectile down the bore and out of the muzzle of the firearm.

Depending on the type of firearm, the projectile is typically shaped with a nose end opposite a base, with a forward end of the projectile defining an ogive region, e.g., an inward taper toward the longitudinal centerline of the projectile. Increasing the length of the ogive region, which increases the nose length and overall length of the projectile, is known to increase the ballistic coefficient of the projectile. However, long-nose projectiles experience a decrease in stability during flight and are more susceptible to increased yaw, or rotation of the nose away from the line of flight. The base can be formed as a flat base, e.g., cylindrical ending in a flat plane, or may be formed with a boat tail, e.g., an inward taper at the base end. The boat tail design is known to decrease the wind drag a projectile will experience along its flight path and increase accuracy at longer ranges.

Due to the nonuniform shape of conventional projectiles, the center of gravity for a given projectile is not defined at the exact center of the projectile. Typically, the center of gravity for a projectile having a boat tail and ogive will be closer to the rear of the projectile. This places the center of gravity behind the center of pressure of the projectile, which is typically found in the ogive region. During flight, external forces acting on the projectile, e.g., wind drag, gravity, etc., can cause what is called an overturning moment, which is when the projectile begins to rotate perpendicularly to the flight path, placing the center of pressure over the center of gravity. In simple terms, the nose of the projectile will experience wind forces that begin to push the projectile into a perpendicular orientation with regard to the original flight path, destabilizing the projectile's flight.

To compensate for the above, modern rifles have barrels that are designed with internal rifling, e.g., spiral grooves defined in the barrel bore, at set twist rates. The internal rifling of the barrel engages the largest diameter section of the projectile as it is propelled out of the firearm to provide rotational spin to the projectile. The rotational spin of the projectile creates gyroscopic forces that resist the overturning moment. Firearm barrels with higher twist rates result in projectiles that experience increased gyroscopic stability during flight.

As stated above, increasing the length of the projectile nose increases the ballistic coefficient but also makes the projectile more susceptible to instability during flight because the center of pressure has been moved further away (in the forward direction) from the center of gravity for the projectile. Further, by increasing the nose length of the projectile, the overall projectile weight goes up, which ultimately results in a decrease in maximum velocity. In sum, there is a tradeoff between attaining higher ballistic coefficient while maintaining stability throughout flight and achieving high velocity rates.

Thus, what is needed is a projectile that can achieve high maximum velocities with a high ballistic coefficient while maintaining stability throughout flight.

SUMMARY OF THE INVENTION

The invention disclosed herein relates generally to an improved long range projectile. Specifically, the inventive concepts relate to an improved polymer jacketed long range projectile and methods for making such projectile. The disclosed projectile and associated methods can be readily applied to virtually any caliber of projectile used in small, medium and large arms ammunitions.

In one embodiment, a long range projectile has a core body with a defined base end and a forward end which tapers inwardly toward the longitudinal centerline to form a core ogive. A recessed cavity is defined at the base end and extends into the core body. The recessed cavity reduces the amount of material of the core body, thus lessening the overall weight of the core in comparison to conventional long range projectiles. A polymer jacket is formed around the core. The polymer jacket includes a protrusion, made of the same or different polymer material as the jacket, which fills the recessed cavity.

In further embodiments, the nose of the polymer jacket may extend past the forward end of the core body forming a hollow point long range projectile or the nose of the polymer jacket may be pointed. The base end of the core body can also taper in a rearward direction toward the longitudinal centerline to define a boat tail.

In preferred embodiments, the recessed cavity is cylindrically shaped and concentrically aligned about the longitudinal centerline of the projectile. The recessed cavity filled with the polymer protrusion is configured to move the center of gravity of the long range projectile in a forward direction by lessening the overall weight of materials at the base end. The center of gravity is preferably moved closer to the nose end of the long range projectile when compared to a conventional long range projectile of the same caliber. In some embodiments, the recessed cavity can extend at least 25% the length of the core body defined from the base end to the forward end. The recessed cavity can have an internal taper, tapering inwards from the base end to the forward portion of the cavity.

In preferred embodiments the core of composed of at least one compressed metal powder, e.g., tungsten metal powder. The core can also comprise at least one filler material, for example, a second metal powder chosen from the group of zinc, tin or aluminum.

A method for manufacturing the long range projectile is also disclosed. In one such method, the core material is provided as a small metal disc and pressed through a mechanical die press to form the forward taper defining the ogive. In embodiments including a boat tail, the boat tail is formed while the ogive region is formed. The core can be made from conventional lead materials. The recessed cavity is thereafter bored out from the base end. This can be done using a drill or other boring tool. The specific dimensions of the recessed cavity can be controlled as a means to control the overall reduction in mass and the specific movement of the center of gravity, e.g., a larger cavity will increase the overall mass reduction and subsequently move the center of gravity further forward in the final projectile.

Thereafter, the core having the recessed cavity is centered in a mold with the cavity facing the injection gates. Polymer is then injected into the mold from the gates according to conventional injection molding processes. By injecting the polymer from the rearward direction of the core, i.e., at the recessed cavity, the process ensures the entire cavity will be filled with the polymer material. Further, the gate lines can be found at the rear of the jacket, i.e., the base end of the projectile, therefore reducing or eliminating the effects these lines can have on the aerodynamics of the long range projectile.

BRIEF DESCRIPTION OF THE DRAWINGS

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. Component parts shown in the drawings are not necessarily to scale, and may be exaggerated to better illustrate the important features of the invention. Dimensions shown are exemplary only. In the drawings, like reference numerals may designate like parts throughout the different views, wherein:

DETAILED DESCRIPTION OF THE INVENTION

The following disclosure presents exemplary embodiments and methods for manufacturing long range, lightweight polymer jacketed projectiles with increased stability. The inventive concepts disclosed herein can be applied to projectiles for military or civilian use. Further, these projectiles can come in a variety of known calibers, ranging in diameter from about 1.50 mm to about 158.00 mm. Thus, the polymer jacketed projectiles disclosed herein and corresponding methods can be used for both pistol and rifle projectiles as well as large artillery rounds.

Throughout this disclosure, the terms "polymer" and "synthetic polymer" and "synthetic coating" shall be interpreted in a non-limiting fashion and given a broad interpretation according to their plain and ordinary meaning. "Polymer" can mean a natural polymer or a synthetic polymer, and any invention described herein that refers to a "synthetic polymer" may, in an alternative embodiment, substitute a natural polymer for the synthetic polymer and vice versa. Examples of polymers as used herein include but are not limited to acrylic, polyethylene, polyolefin, polypropylene, polystyrene, polyvinylchloride, synthetic rubber, phenol formaldehyde, neoprene, nylon, polyacrylonitrile, PVB, silicone, and any of the foregoing in powdered, micronized powdered, or resin form.

The disclosed projectiles have a lighter overall mass, allowing the projectile to achieve a higher maximum velocity. Further, the manner in which the projectile mass is lightened results in movement of the center of gravity forward along the longitudinal length of the projectile, resulting in more stability over the course of the flight path and increased resistance to the overturning moment.

Figure 1:
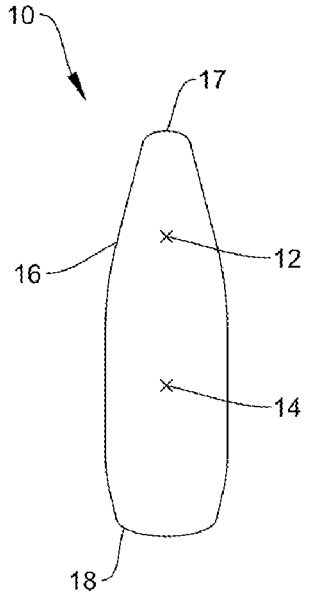
FIG. 1 (Prior Art)
FIG. 1 is a side view of conventional projectile known in the prior art.

FIG. 1 is a side view of a conventional projectile 10. The conventional projectile 10 may be jacketed according to conventional TMJ or FMJ procedures to add stability to the shape of projectile 10, as is known in the art. As is common with most projectiles, the projectile 10 has an inward taper toward the longitudinal centerline at the forward end defining the ogive region 16. Similarly, the projectile 10 can have an inward taper at the base end to form a conventional boat tail 18. The center of pressure 12 is defined at some point forward from the exact center of the projectile 10 in the ogive region 16. The center of gravity 14 is defined at some point behind the exact center of the projectile 10, closer to the boat tail 18 than the nose 17. Due to the center of pressure 12 being in front of the center of gravity 14, the projectile 10 is not stable and requires spin when fired to resist the overturning moment (see above for further discussion).

Figure 2:
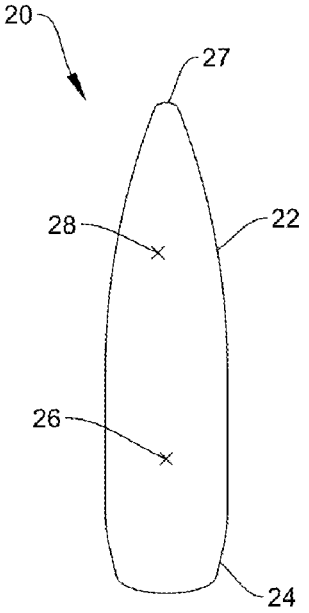
FIG. 2 (Prior Art)
FIG. 2 is a side view of a conventional long range projectile having an elongated ogive known in the prior art.

FIG. 2 is a side view of a conventional long range projectile 20. The long range projectile 20 has a noticeably longer, more pronounced ogive region 22. The longer ogive 22 in the long range projectile 20 places the center of pressure 28 closer to the nose 27. Further, by lengthening the ogive 22, the center of gravity 26 is moved farther back closer to the boat tail 24. The long range projectile 20 therefore increases the distance between the center of pressure 28 and center of gravity 26, which results in less stability during flight and requires higher rates of spin to resist the overturning moment.

Figure 3:
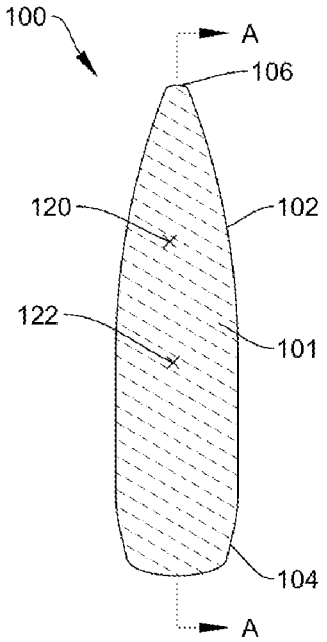
FIG. 3 is a side view of one embodiment of a jacketed long range projectile according to the present invention.

FIG. 3 is a side view of one embodiment of a long range jacketed projectile 100 according to the inventive concepts disclosed herein. The long range jacketed projectile 100 has an outer jacket 101 in which the core 103 is disposed. Preferably, the jacket 101 is formed from one or more polymer materials. Use of polymer materials in forming the jacket 101 reduces the overall weight of the long range jacketed projectile 100, which allows the projectile to attain higher velocities in comparison to the conventional long range projectile 20. The overall weight reduction will depend on the thickness of the polymer jacket 101 and the materials used. A thicker polymer jacket 101 will increase the weight reduction for an equivalently sized and shaped long range projectile 20 formed from metal by reducing the size of the core 103 disposed therein.

The long range jacketed projectile 100 has an elongated ogive 102 formed by the forward end tapering inward toward the longitudinal centerline. The nose 106 can be flat, as shown, or can be pointed or formed as a hollow point by overturning the forward most end of the nose in on itself to form an open cavity. Opposite the nose 106, the base 107 of the long range projectile 100 has an inward taper toward the longitudinal centerline forming the boat tail 104.

Figure 4:
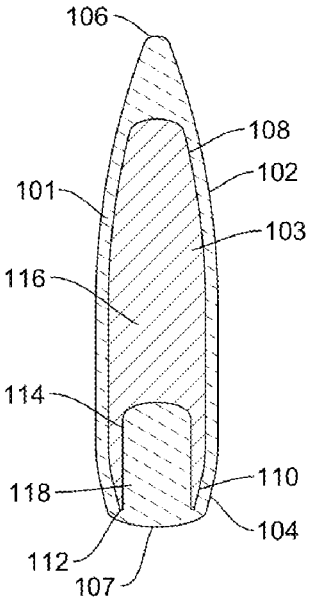
FIG. 4 is a side cross-sectional view of the embodiment of the jacketed long range projectile of FIG. 3 taken along section lines A-A.

FIG. 4 is a cross sectional view of the long range jacketed projectile 100 taken along section lines A-A of FIG. 3. In this view, the core 103 is visible and has been formed with a core ogive 108 which matches the ogive 102. Similarly, the core 103 has a boat tail 110 matching boat tail 104. This ensures the core 103 is properly seated and balanced within the jacket 101.

Defined in the core base 112 in a recessed cavity 114 that extends inwardly a distance into the core body 116. The cavity 114 is preferably cylindrically shaped and concentrically aligned about the longitudinal centerline of the long range jacketed projectile 100. During the jacketing process, detailed below, the polymer of the polymer jacket 101 fills the cavity 114 to form a protrusion 118. The protrusion 118 completely fills the cavity 114 with a material lighter than the material the core 103 is composed of, thus lessening the overall weight of the long range projectile 100. The width and depth of the cavity 114, and the subsequent amount of polymer forming the protrusion 118, can be controlled to control the overall weight of the projectile 100. Further, by forming the cavity 114 and counter filling it with the lighter material of the jacket protrusion 118, the center of gravity 122 is moved closer to the center of pressure 120 for the long range jacketed projectile 100 when compared to the conventional long range projectile 20.

The cavity 114 counter filled with the protrusion 118 increases stability of the long range jacketed projectile 100 by lessening the distance between the center of pressure 120 and the center of gravity 122 while maintaining the advantages of the longer ogive region 102. Further, the cavity 114 reduces the overall weight of the core 103, which in turn results in an overall lighter projectile that can achieve higher velocities and faster spin rates to resist the overturning moment.

In alternative embodiments, the cavity 114 can extend substantially the entire longitudinal length of the core 103 from the core base 112 to the opposite end. The inner surface of the elongated cavity can include one or more grooves defined therein. The protrusion similarly fills the grooved elongated cavity. The grooved elongated cavity filled with the polymer protrusion causes in an increase in the frangibility of the projectile upon impact with a target. The grooves in the elongated cavity create a plurality of predetermined fracture lines in the core. Upon impact with a target, the projectile fracture along the grooves defined in the elongated cavity, thereby increasing the terminal ballistics of the projectile. The elongated cavity also causes further movement of the center of gravity in a forward direction along the longitudinal projectile length, thereby increasing the stability of the projectile during flight. Further, such an embodiment will experience a further increase in the maximum attainable velocity by further reducing the overall weight of the projectile.

Figure 5:
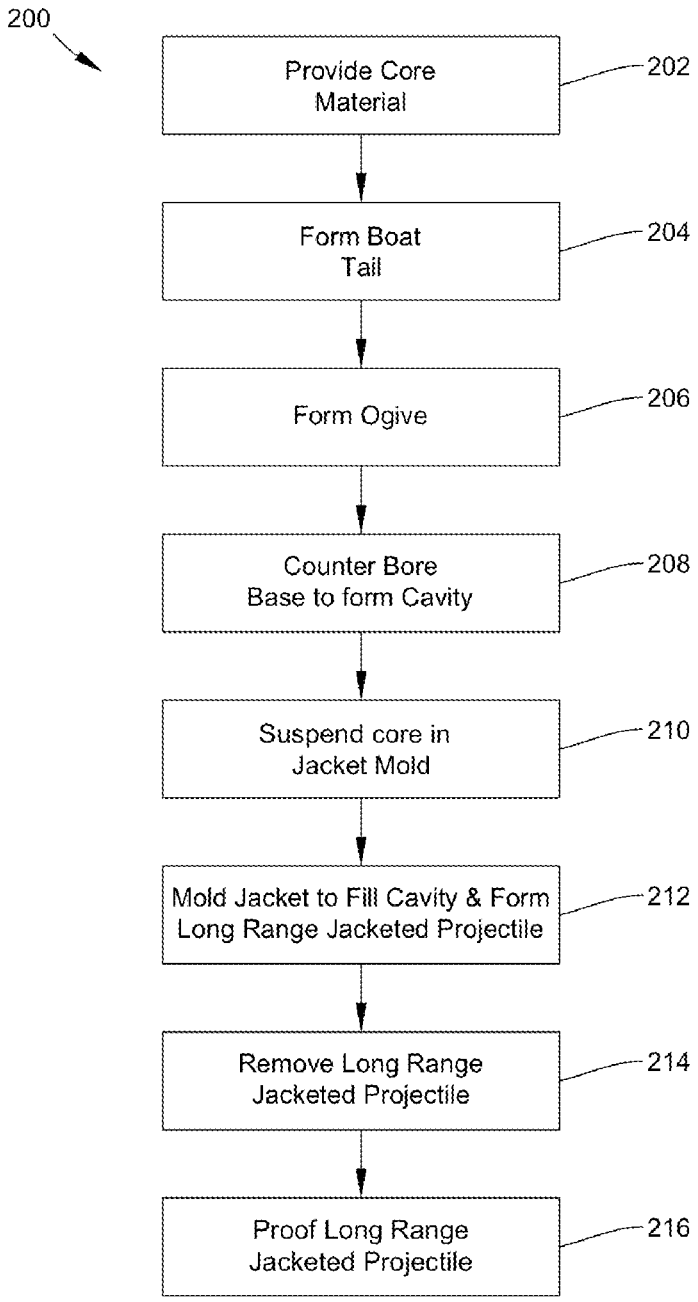
FIG. 5 is a flow chart diagraming the salient steps of one method for forming a jacketed long range projectile according to the present invention.

FIG. 5 is a flow chart diagraming the salient steps of method 200 for forming a long range jacketed projectile 100 according to the present inventive concepts. At step 202, the core material is provided. The core 103 can be the soft lead material that is used as a core for conventional jacketed projectiles. However, other alternative materials, such metal powders of tungsten, tin, zinc, aluminum, etc., can be used. At step 204, the core boat tail 110 is formed and at step 206, the core ogive 108 is formed. Steps 204 and 206 can involve conventional die pressing using hydraulic force to form the desired shape of the core. Alternatively, and more preferably, steps 204 and 206 can involve metal injection molding where one or more metal powders, such as tungsten, tin, zinc, etc., are mixed and heated together to a melting point. The heated metal powders are then injected into a core having the desired shape, e.g., desired ogive profile and boat tail profile. In such steps, it is preferred to use tungsten as a primary metal powder of about 85% total core weight and tin as filler metal powder to make up the remaining 15% total core weight. However, alternative quantities of these metal powders may be used. Similarly, alternative metal powder types may be used.

Once the core 103 has been formed and the desired profile defined, at step 208 the cavity 114 is counter bored into the core body 116 from the core base 112. The dimensions of the cavity 114 can be varied to control the weight reduction and movement of the center of gravity. The counter boring at step 208 results in a uniform cavity 114 defined through the core base 112. The cavity 114 can be bored out by drilling the cavity in the core 103 where the core is a conventional solid form core, e.g., conventional soft lead core. Alternatively, the cavity 114 can be bored out using a die and punch combination where the core 103 is molded from one or more metal powders according to metal injection molding techniques. However, even where the core 103 is formed through injection molding techniques, the cavity 114 may still be formed by drilling out the base end.

At step 210, the core 103 is suspended in a jacket mold to prepare the core for polymer injection molding. The core 103 is balanced in the mold so that the cavity 114 is oriented toward the injection gate(s). By orienting the core 103 in the mold with the cavity 114 facing the gates, it is ensured that the polymer material will completely fill the cavity to reliably form the protrusion 118 while at the same time forming the remainder of the jacket 101 about the core. The jacket mold may include more than one gate, with a second injection gate oriented at the nose of the projectile. In such molds, polymer is injected from substantially opposite ends of the mold. Regardless of the number of gates included, it is preferred that the core 103 be oriented in the jacket mold such that the cavity 114 faces at least one of the gates to ensure it is completely filled with the polymer material.

After the core 103 has been balanced in the jacket mold and correctly oriented, at step 212 the polymer jacket 101 is injection molded over and about the core. The polymer injection molding step 212 is accomplished according to known and conventional injection molding processes. For example, one or more polymer materials selected for the jacket 101 are uniformly mixed and heated. The mixed polymer materials are then injected into the jacket mold where the jacket 101 is formed over the core and the protrusion 118 fills the cavity 114 in the core 103.

After the long range jacketed projectile 100 has been molded, at step 214 the projectile is removed from the mold. With each injection molding step, e.g., after the core 103 has been metal injection molded and after the jacket 101 has been polymer injection molded over the formed core, the molded piece is allowed to cool so as to maintain shape, as is conventional in injection molding processes. The cooling can be accomplished by removing the piece from the mold and exposing it to ambient air prior to the next step.

After removal of the long range jacketed projectile 100 from the mold, a final proofing step 216 can be applied. The proofing step 216 involves pressing the long range jacketed projectile 100 through a proof die which is designed to remove polymer in excess of the maximum outer diameter of the projectile, as determined by the specific caliber. Excess polymer may come in the form of gate seams created as a byproduct of the injection molding process or be other impurities formed on the outer surface of the projectile 100.

The method steps disclosed herein have been described in linear fashion but the skilled artisan will understand that one or more steps may be accomplished simultaneously.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A long range projectile for use in an ammunition cartridge, the projectile comprising:

a core body having a base end and an elongated forward end tapering inwardly toward a longitudinal centerline to define an elongated core ogive;

a recessed cavity defined at the base end and extending into the core body; and a polymer jacket encompassing the core body, wherein the jacket includes a protrusion filling the recessed cavity.

2. The projectile of claim 1, wherein a nose of the polymer jacket extends past the forward end of the core body to form a hollow point.

3. The projectile of claim 1, wherein a nose of the polymer jacket is pointed.

4. The projectile of claim 1, wherein the base end tapers inwardly in a rearward direction toward the longitudinal centerline to form a boat tail.

5. The projectile of claim 1, wherein the recessed cavity reduces overall weight of the projectile in comparison to a conventional long range projectile of a same caliber.

6. The projectile of claim 1, wherein the recessed cavity is cylindrically shaped.

7. The projectile of claim 1, wherein the recessed cavity is concentrically aligned about the longitudinal centerline of the projectile.

8. The projectile of claim 1, wherein the recessed cavity is configured to move a center of gravity of the projectile in a forward direction.

9. The projectile of claim 8, wherein the center of gravity is moved closer to a nose end of the projectile when compared to a conventional long range projectile of a same caliber.

10. The projectile of claim 1, wherein the recessed cavity extends at least 25% a core body length defined from the base end to the forward end.

11. The projectile of claim 1, wherein the recessed cavity is tapered.

12. The projectile of claim 1, wherein the core is composed of at least one compressed metal powder.

13. The projectile of claim 12, wherein the compressed metal powder is a tungsten metal powder.

14. The projectile of claim 13, wherein the core further comprises at least one filler material.

15. The projectile of claim 14, wherein the at least one filler material is a second metal powder.

16. The projectile of claim 15, wherein the second metal powder is chosen from a group consisting of zinc, tin or aluminum.

17. A method for forming a long range projectile comprising the steps of:

molding a core body having a defined base end and an opposite forward end with an inward taper toward a longitudinal centerline forming an elongated ogive;

boring a recessed cavity in the base end of the core body; and molding a polymer jacket around the core body and a protrusion filling the recessed cavity.

18. The method of claim 17, further comprising the step of suspending the core body in a jacket mold with the recessed cavity facing a primary injection gate, and injecting polymer into the mold from the injection gate.

19. The method of claim 17, wherein the molding of the core body further comprises molding a boat tail at the base end.

20. The method of claim 17, wherein the molding of the core body comprises metal injection molding the core body from a tungsten metal powder.

* * * * *